US008206058B2

(12) United States Patent
Vrondran et al.

(10) Patent No.: US 8,206,058 B2
(45) Date of Patent: Jun. 26, 2012

(54) MANHOLE COVER HINGE ASSEMBLY

(75) Inventors: Kevin S. Vrondran, East Jordan, MI (US); David E. Fuller, Ellsworth, MI (US); Jeremy I. Johnson, East Jordan, MI (US)

(73) Assignee: East Jordan Iron Works, Inc., East Jordan, MI (US)

( * ) Notice: Subject to any disclaimer, the term of this patent is extended or adjusted under 35 U.S.C. 154(b) by 550 days.

(21) Appl. No.: 12/173,276

(22) Filed: Jul. 15, 2008

(65) Prior Publication Data

US 2010/0012671 A1 Jan. 21, 2010

(51) Int. Cl.
*B65D 43/24* (2006.01)
*E02D 29/14* (2006.01)

(52) U.S. Cl. ..... 404/25; 220/831; 220/836; 52/20

(58) Field of Classification Search ..... 220/810, 220/836, 841, 842, 845, 831; 49/243, 383, 49/397; 52/19, 20; 404/25, 26
See application file for complete search history.

(56) References Cited

U.S. PATENT DOCUMENTS

| | | | | |
|---|---|---|---|---|
| 1,923,481 | A * | 8/1933 | Ford | 220/484 |
| 4,840,514 | A * | 6/1989 | Defrance et al. | 404/25 |
| 7,160,051 | B1 * | 1/2007 | Cuny et al. | 404/25 |
| 7,448,512 | B2 | 11/2008 | Hauer et al. | |
| 7,908,710 | B2 * | 3/2011 | Monneret et al. | 16/260 |
| 8,006,439 | B2 * | 8/2011 | Hauer et al. | 52/19 |
| 2004/0128919 | A1 * | 7/2004 | Hauer et al. | 52/19 |

OTHER PUBLICATIONS

Pictures of manhole cover and frame, Prior Art.

* cited by examiner

*Primary Examiner* — Mickey Yu
*Assistant Examiner* — Kareen Rush
(74) *Attorney, Agent, or Firm* — Warner Norcross & Judd LLP

(57) ABSTRACT

A manhole cover assembly includes a frame defining an access opening, first and second mounting posts extending from the frame, and a cover for covering the access opening. The cover includes first and second mounting recesses that pivotally receive the first and second mounting posts respectively, such that said cover is movable between an open position and a closed position by rotating the recesses about the posts. At least one of the recesses includes a locking groove that aligns with the post when the cover is moved to an open position to lock the cover in the open position.

15 Claims, 15 Drawing Sheets

MANHOLE COVER HINGE ASSEMBLY

BACKGROUND OF THE INVENTION

The present invention relates to a hinge assembly, and more particularly to a hinged manhole cover assembly that provides a safety lock for the cover.

Manhole covers are well known. Generally, a manhole cover is a removable plate forming the lid over the opening of a manhole to, among other things, prevent someone from falling in and to keep unauthorized persons out. Manhole covers often weigh more than 100 pounds, partly because the weight keeps them in place when traffic passes over them, and partly because they are often made out of cast iron, sometimes with infills of concrete. This makes them inexpensive and strong, but heavy. The often feature pick holes, in which a hook handle is inserted to lift them up.

Because of the weight of manhole covers, they often feature lift assemblies to assist users in opening and closing the covers. For instance, they may include a spring-assisted or gas-assisted cylinder connected between the cover and the frame to make them easier to open. As an added feature, some manhole covers, both manual and lift-assisted, include hinges on the frame and the cover to allow the cover to pivot between a closed position covering the manhole access opening, and an open position providing access to the manhole opening.

As an added safety feature to prevent a hinged manhole cover from swinging closed, it is known to provide a locking mechanism that holds the cover in the open position. One such cover includes a hinge assembly having a pair of rectangular tabs extending from the cover. Each tab fits into a slot on the frame. One of the tabs is seated on a ledge when the cover is in the closed position, and when the cover is moved to the open position, the tab falls off the ledge into a vertical slot that holds the cover in the open position until a user lifts the cover vertically to pull the tab out of the slot. Unfortunately, this arrangement suffers from a number of drawbacks. For instance, over time, dirt and other debris collects in the vertical slot, and, as a result, the tab no longer fits into the slot to lock the cover in the open position. This problem can be resolved by creating a hole, or "clean-out," in the bottom of the slot that allows the dirt and other debris to fall through the slot and into the manhole opening, but the resulting cover assembly is no longer leak tight. In addition, the rectangular tabs pivot awkwardly when opening the cover, which can make manually lifted covers especially cumbersome to open.

SUMMARY OF THE INVENTION

The present invention provides a manhole cover with a leak tight, user friendly hinge assembly that is capable of locking the cover in a desired position.

In one embodiment, the manhole cover assembly includes a frame having a peripheral wall defining an access opening, and first and second frame extensions adjacent to the peripheral wall. The frame extensions each include a sidewall, a floor, and a cover mount post extending from the sidewall. The cover mount posts are positioned above the floors of the frame extensions so that the frame extensions are leak tight. The manhole cover includes first and second mounting tabs, each with a recess that rotatably receives one of the cover mount posts. The mounting tabs rotate about the cover mount posts between a closed position covering the access opening and an open position providing access to the access opening. A first one of the mounting tabs and a first one of the cover mount posts include locking structure for locking the cover in a particular position, such as the open position, when the cover is rotated to the open position.

In one embodiment, the locking structure is a locking groove that extends from the recess of the first locking tab. The first cover mount post may be shaped to slide into the locking groove when the cover is pivoted to the open position. For instance, the first cover mount post may include opposing, parallel flat surfaces that align with the locking groove when the cover is moved to the open position. In another embodiment, the recess on the first locking tab includes a generally round first portion, and a locking groove extending from the first portion and having opposing, parallel sides. The first cover mount includes opposing, parallel, generally flat sides extending in the same direction as the parallel sides of the locking groove. The cover mount post rotates within the first portion until the cover is in the open position, when the opposing, parallel sides of the cover mount post align with those of the locking groove and the post slides into the locking groove. The mounting tabs may each include a slot opening that permits removal of the cover from the frame in the open position.

In yet another embodiment, the floor of the frame extension that includes the first cover mount post may include a protrusion extending upwardly from the floor. The protrusion extends into the slot opening of the first mounting tab when the cover is in the open position to provide additional resistance against the closing of the cover. The cover is lifted above the protrusion in order to move it to the closed position. The protrusion may additionally include an angled surface that supports the cover in a use position, wherein the cover is opened to a greater degree than the open position.

The combination of the cover mount posts extending from the frame and the recesses in the cover enables smooth, user friendly opening and closing of the cover, while the floors beneath the cover mount posts enable a leak tight manhole cover assembly.

These and other objects, advantages, and features of the invention will be readily understood and appreciated by reference to the detailed description of the current embodiment and the drawings.

DETAILED DESCRIPTION OF THE CURRENT EMBODIMENT

I. Overview

Figure 1:
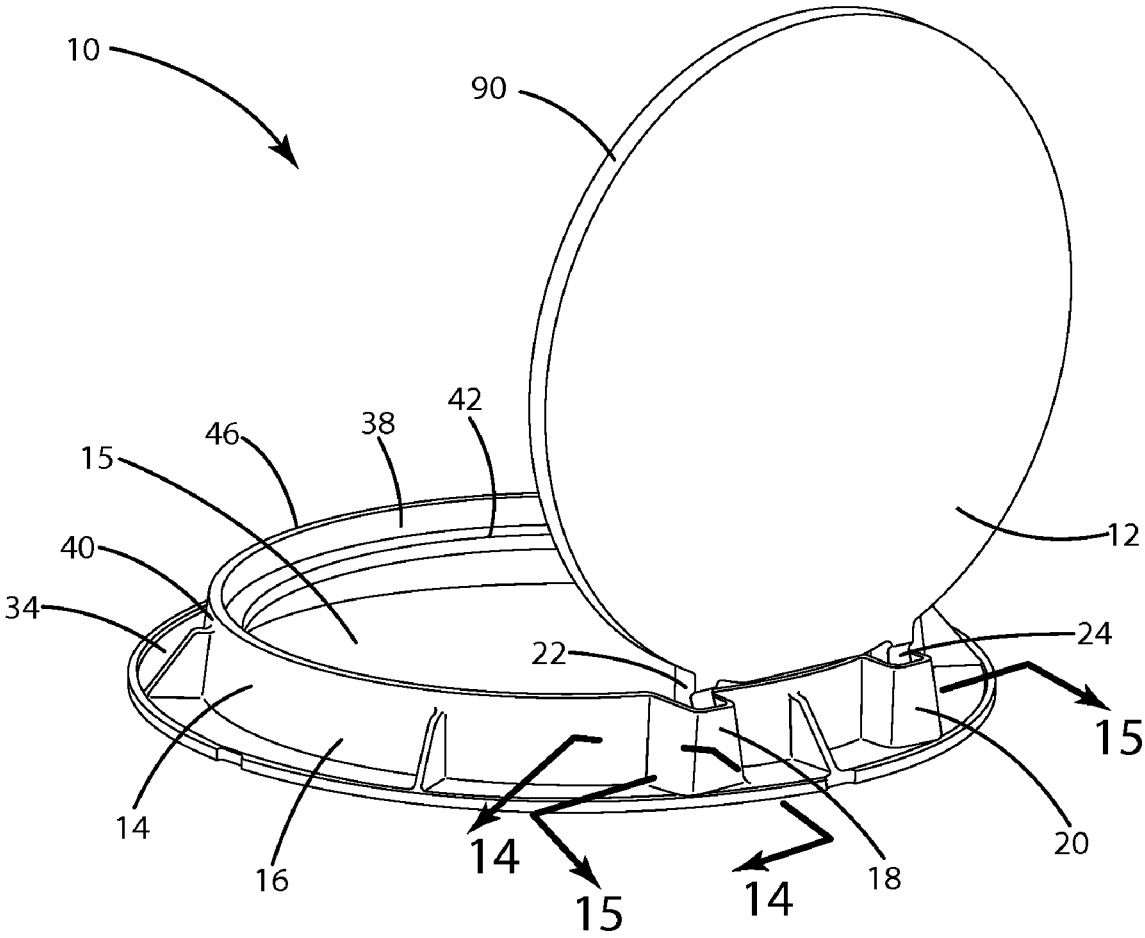
FIG. 1 is a rear perspective view of a manhole cover assembly in an open position according to one embodiment of the present invention.
Figure 7:
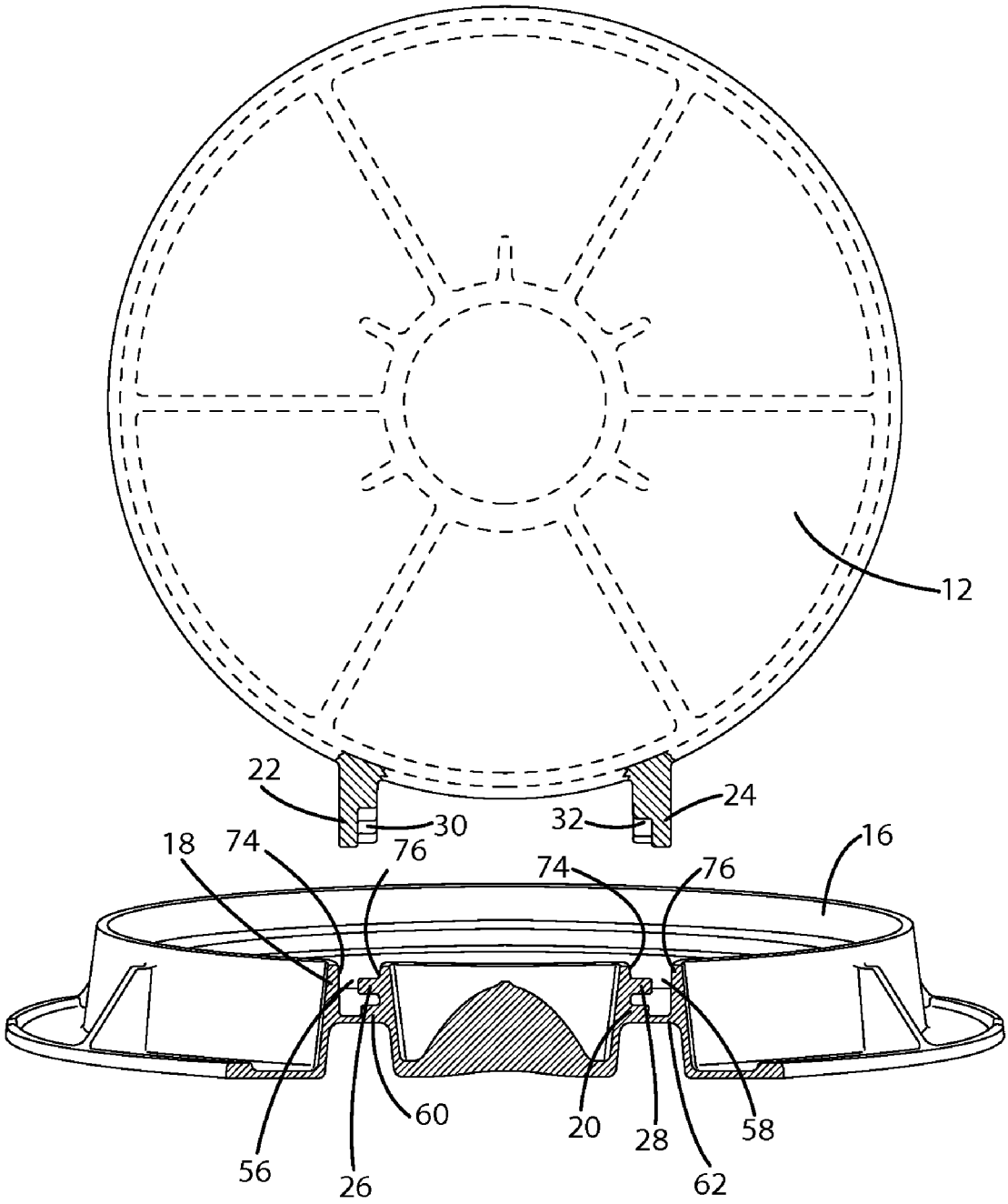
FIG. 7 is a front exploded view of the manhole cover assembly including a cross-sectional view of the frame taken along line 7-7 in FIG. 5.

A manhole cover assembly according to one embodiment of the present invention is shown in FIG. 1 and generally designated 10. The manhole cover assembly 10 generally includes a manhole cover 12 and a frame 14 hingedly mounted to the cover 12. In the illustrated embodiment, the frame 14 includes a peripheral wall 16 and first and second frame extensions 18, 20 extending from the peripheral wall 16. The cover 12 includes first and second mounting tabs 22, 24 extending from the cover 12. As shown in FIG. 7, each frame extension 18, 20 includes a cover mount post 26, 28, and each mounting tab 22, 24 includes a recess 30, 32 that receives one of the cover mount posts 26, 28 such that the cover mount posts 26, 28 can pivot within the recesses 30, 32 to move the cover between a closed position (shown in FIG. 2) and an open position (shown in FIG. 1). A first one of the mounting tabs 22 and a first one of the recesses 30 are shaped such that they lock the cover 12 in place when the cover 12 is moved to the open position.

II. Structure

The described embodiment may be used as a manhole cover assembly to cover an access opening 15 and provide access to an infrastructure, such as a drainage and sewer infrastructure system, underneath the opening 15. Although the manhole cover assembly may be installed over any suitable hole, it will often be installed over a manhole in a street or sidewalk. As noted above, the manhole cover assembly generally includes a frame 14 and a cover 12, each of which are described in more detail below.

In the illustrated embodiment, the frame 14 is a generally peripheral structure including a base 34, and a peripheral wall 16 extending upwardly from the base 34 including an inner surface 38 and an outer surface 40. The illustrated embodiment includes a cover receiving flange 42 disposed on the inner surface 38, and first and second frame extensions 18, 20 extending from the peripheral wall 16. In the illustrated embodiment, the frame extensions 18, 20 are U-shaped portions of the peripheral wall 16 that are formed integrally with the peripheral wall 16 as a single, unitary piece. Alternatively, the frame extensions 18, 20 may have a different shape, and may be formed of separate pieces and/or different materials that are attached to the peripheral wall 16, or positioned adjacent to the peripheral wall 16, or another portion of the frame 14. The described frame 14 is generally annular and may be installed over a manhole (not shown). The configuration of the top edge 46 and the inner surface 38 of the frame 16 may be selected to interface with the cover 12 to cover the manhole opening. In one embodiment, the frame 14 is installed flush with the surface of a road (not shown).

Figure 5:
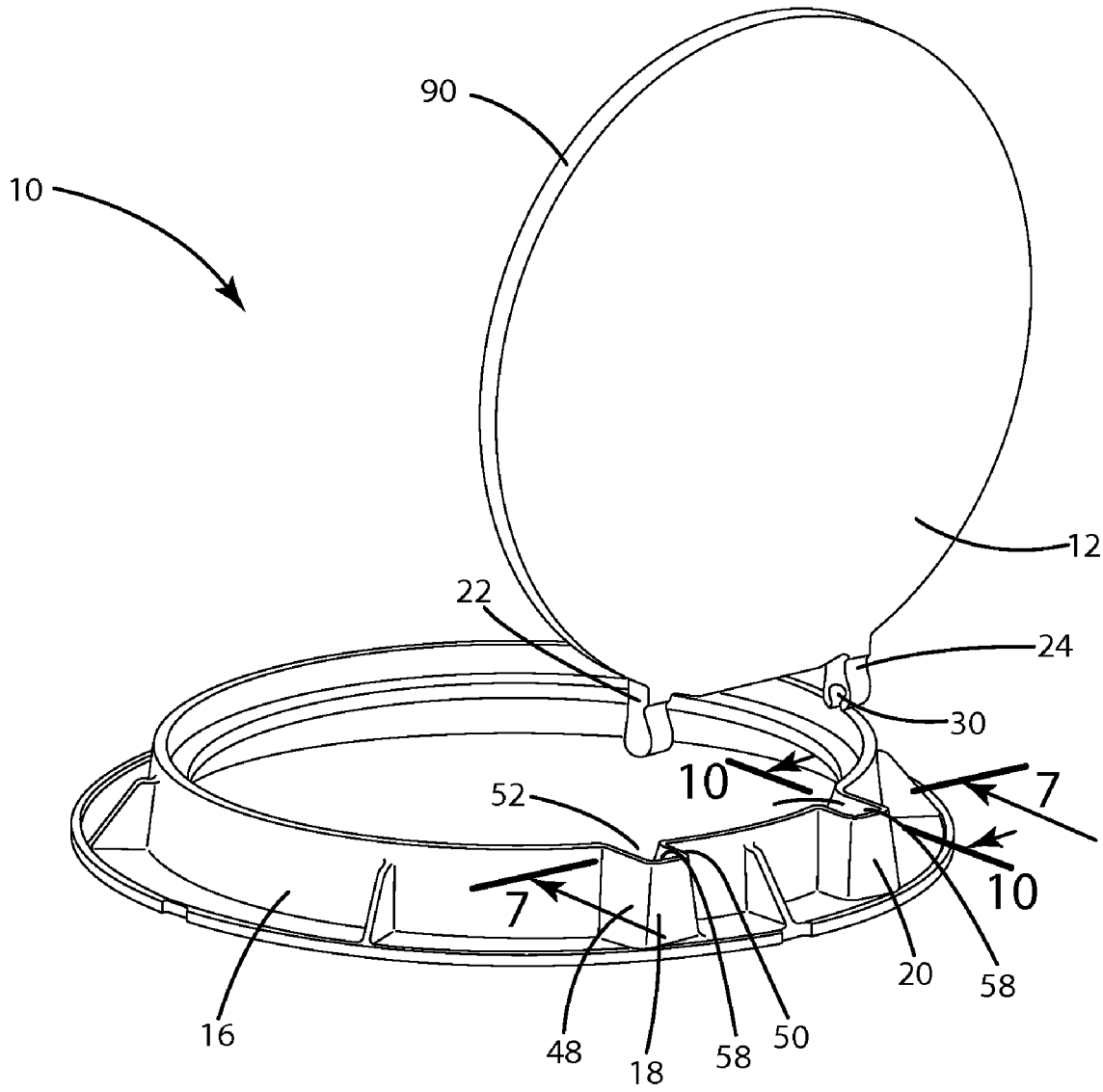
FIG. 5 is an exploded view of the manhole cover assembly.
Figure 6:
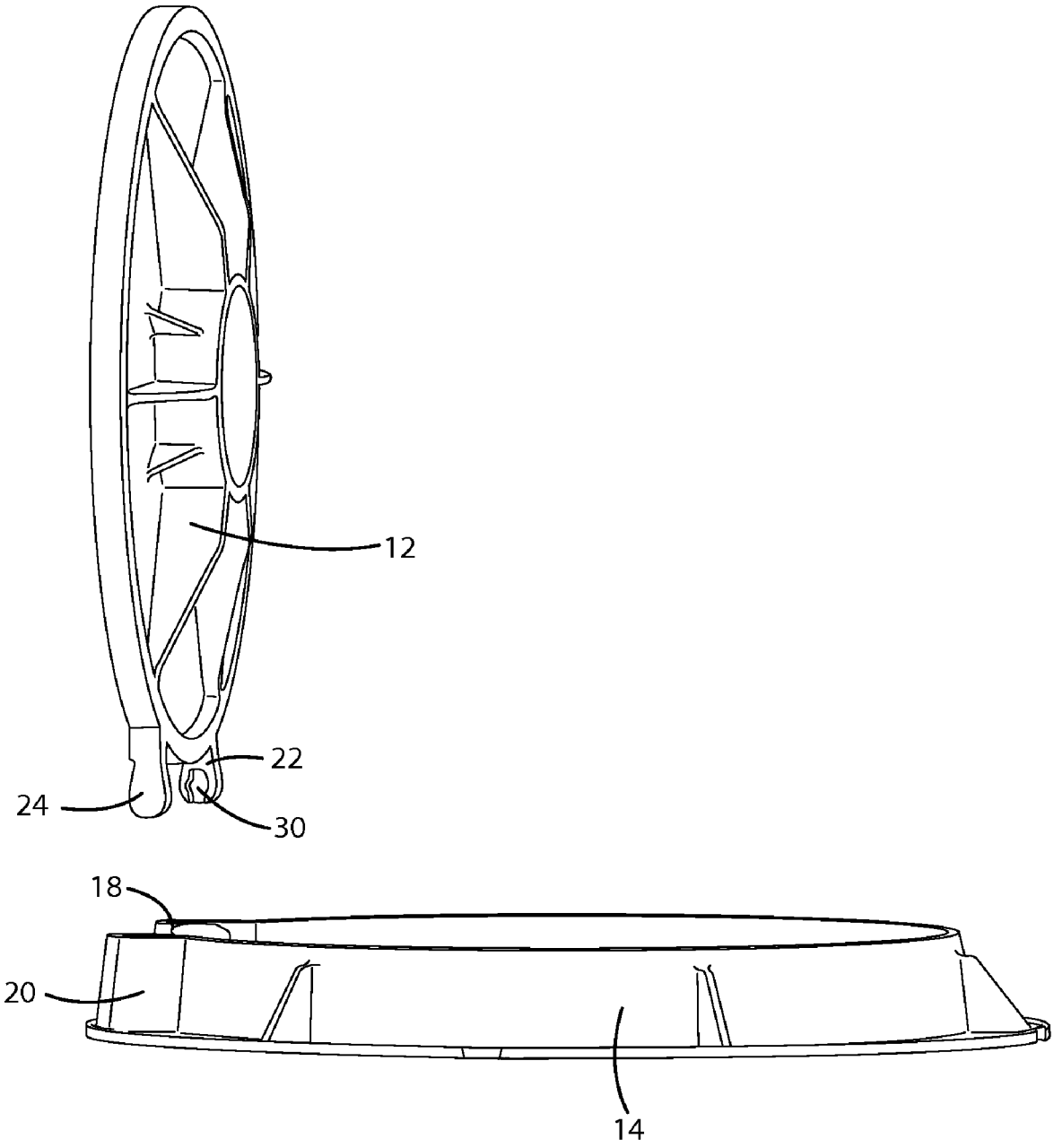
FIG. 6 is a side exploded view of the manhole cover assembly.
Figure 10:
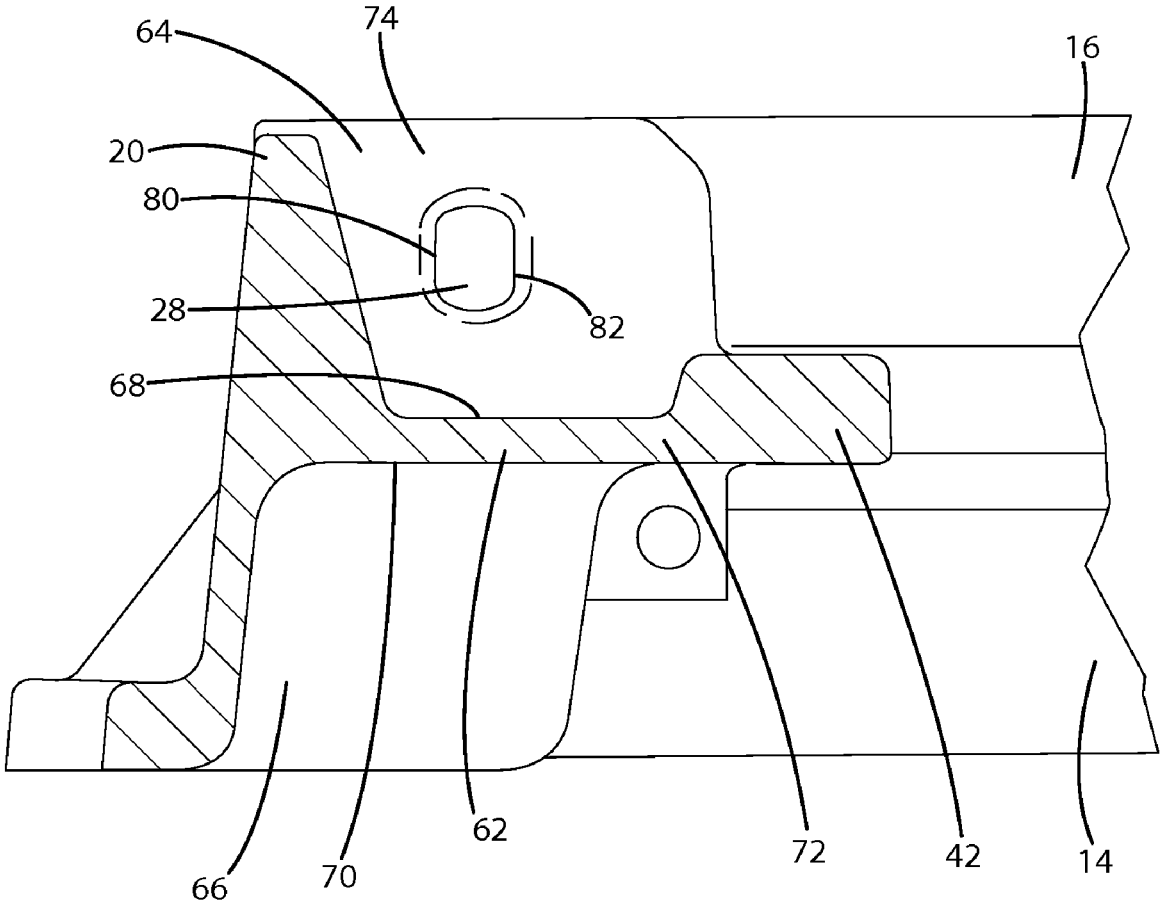
FIG. 10 is a close-up sectional view of the frame taken along line 10-10 in FIG. 5.
Figure 11:
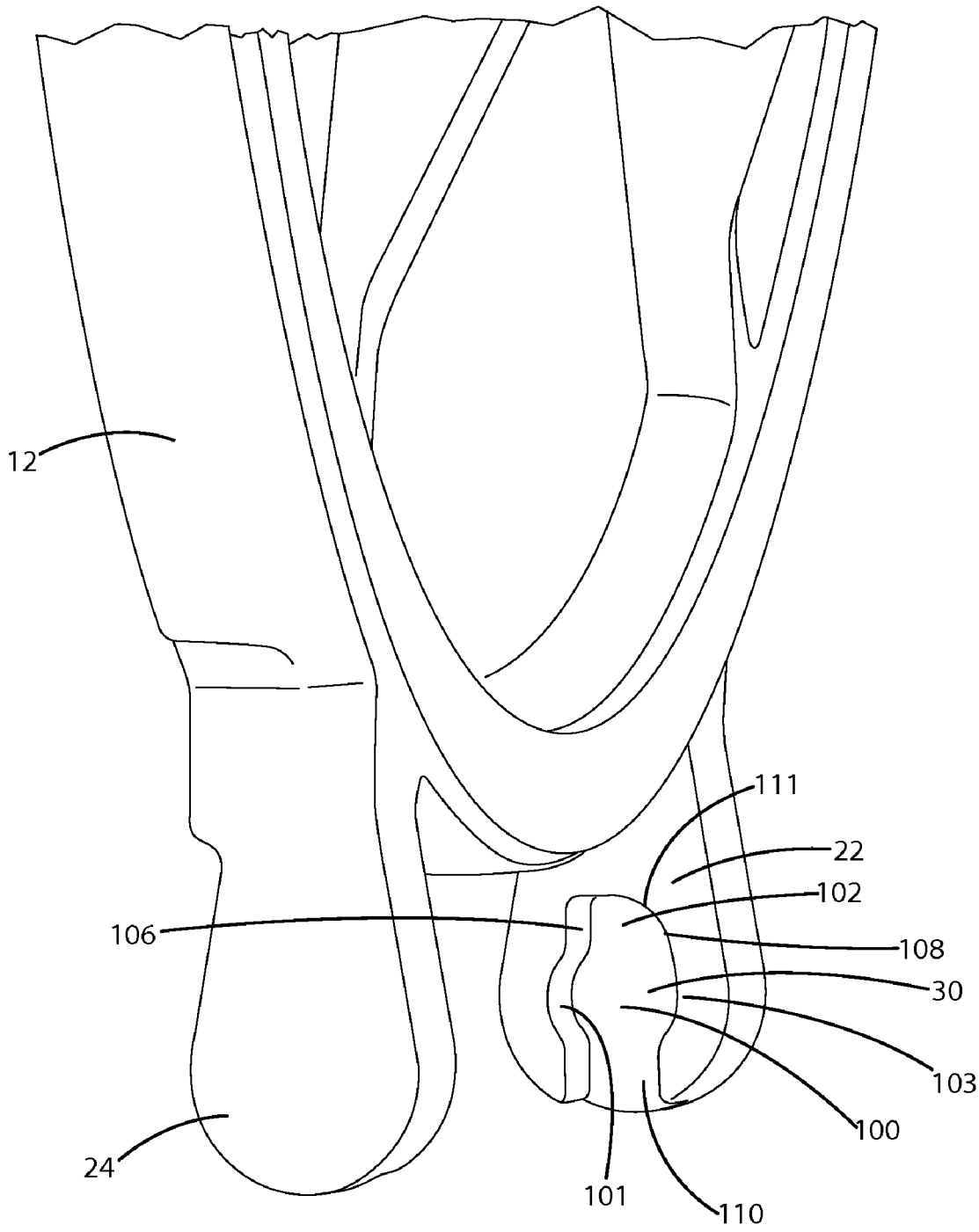
FIG. 11 is a close-up view of the mounting tabs.

Referring now to FIG. 5, as illustrated, the frame extensions 18, 20 are defined in the peripheral wall 16 as U-shaped contours of the wall 16, including sidewalls 48, 50 that each define a mouth 52, 54 and an interior space 56, 58. As shown in FIGS. 7 and 10, each frame extension 18, 20 includes a floor 60, 62 that completely fills the interior space 56, 58 to seal an upper portion 64 of the frame extension located above the floor 60, 62 from a lower portion 66 of the frame extension located below the floor 60, 62, such that the frame extensions 18, 20 are leak tight. The floors 60, 62 each have an upper surface 68, a lower surface 70 and an inner edge 72. In one embodiment, the inner edge 72 of each floor is formed integrally with, and directly connected to, the cover receiving flange 42 with the cover receiving flange 42 extending upwardly from the floors 60, 62 to provide a barrier that prevents the flow of dirt and other debris into the access opening 15.

Figure 13:
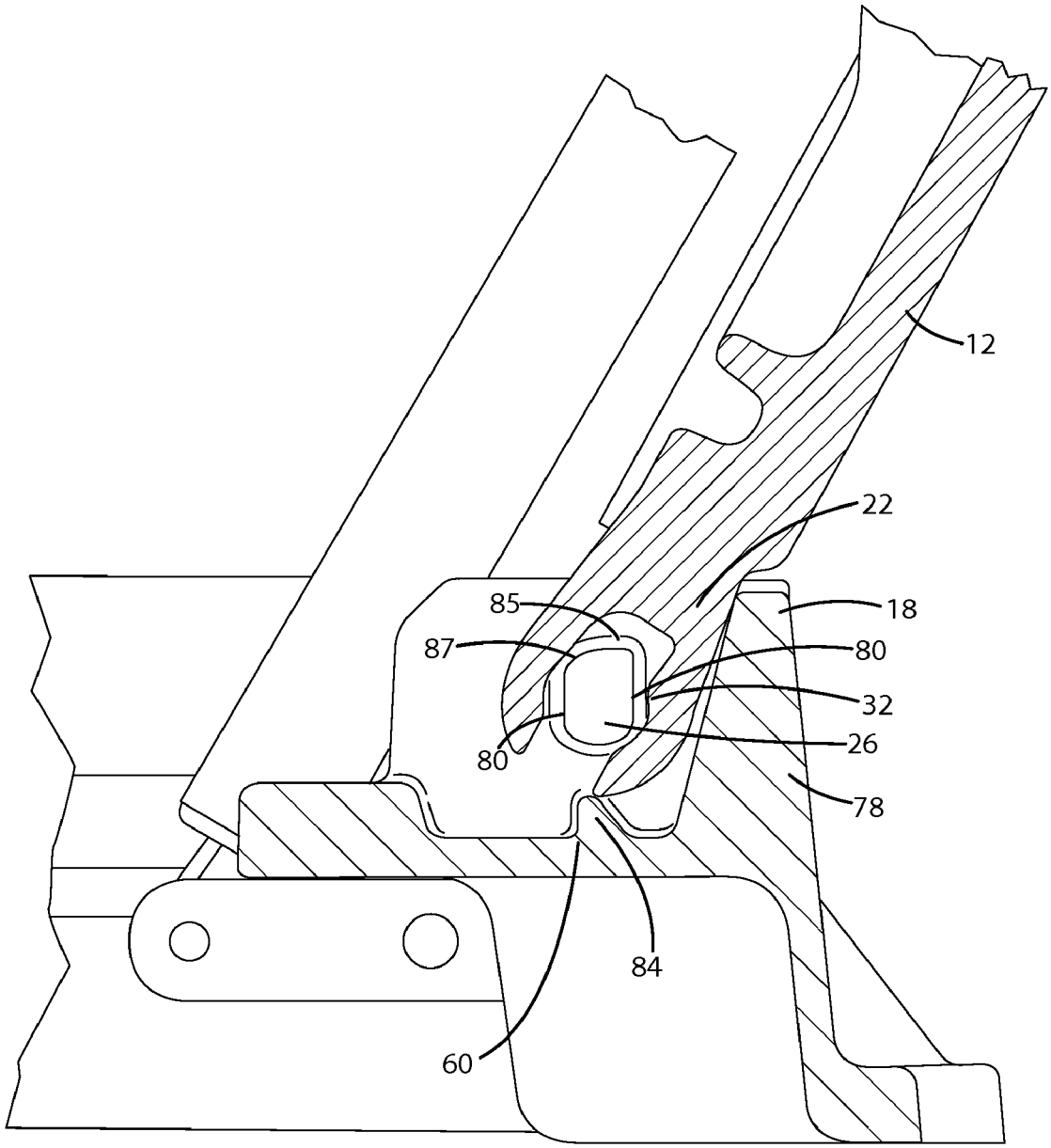
FIG. 13 is a close-up sectional view of the cover assembly in a use position taken along line 13-13 in FIG. 4.

As shown in FIGS. 7-10, each frame extension sidewall 48, 50, includes a first side 74, a second side 76, and an outer wall 78. In one embodiment, a first cover mount post 26 extends from the first side 74 of the first frame extension 18 and a second cover mount post 28 extends from the second side 76 of the second frame extension 20. Alternatively, the cover mount posts 26, 28 could each extend from the opposite walls, or they could each both extend from the first side 74 or second side 76. In the illustrated embodiment, each of the cover mount posts 26, 28 extends approximately halfway across the interior space 56, 58 of the respective frame extension 18, 20. In another embodiment, one or both of the cover mount posts 26, 28 may have a different length, or may extend across the entire interior space 56, 58 from the first side 74 to the second side 76. One or both of the cover mount posts 26, 28 may have a cross section that is shaped to align with a portion of the mounting tab 22, 24, as described below. As shown in FIG. 10, the cross section of the cover mount posts 22, 24 may be generally round, except for a pair of opposing, parallel flat sides 80, 82 extending in a generally vertical direction. As shown in FIG. 13, the cross section of the cover mount post 26 may differ from that of the cover mount post 28. For instance, in the illustrated embodiment, on the cover mount post 26, the flat wall 82 is longer than the opposing flat wall 80 and the top edge 85 of the cover mount post 26 is flattened with a rounded leading edge 87. In one embodiment, shown in FIGS. 7 and 13, the first frame extension 18 may include a protrusion 84 that extends upwardly from the floor 60. As illustrated, the protrusion 84 is positioned below the cover mount post 26 and is triangular in cross section, with the hypotenuse facing the outer wall 78 of the frame extension 18. As described in more detail below, the protrusion 84 engages a portion of the mounting tab 22 when the cover 12 is moved to the open position.

The cover 12 is illustrated having a round shape to match the generally annular shape of the frame 12 and peripheral wall 16. Alternatively, the cover may have a different shape to cover a variety of differently sized access openings and to interfit with a variety of differently sized frames 14. The cover includes a peripheral edge 90, an upper surface 92 and a lower surface 94. As illustrated, the cover 12 includes first 22 and second 24 mounting tabs extending outwardly from the peripheral edge 90 of the cover 12 and spaced to fit into the first and second frame extensions 18, 20. Alternatively, the mounting tabs 22, 24 may be located within the periphery of the cover 12.

Figure 4:
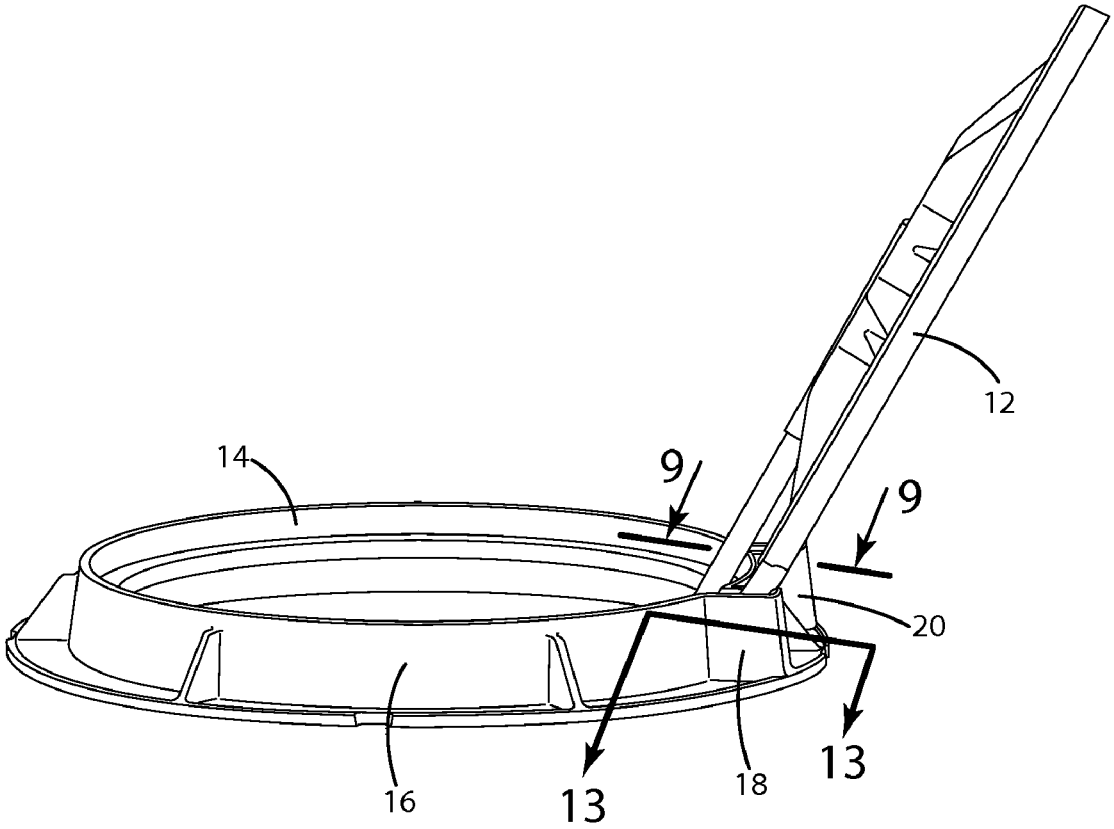
FIG. 4 is a side view of the manhole cover assembly in a use position.

In one embodiment, the mounting tabs 22, 24 each define a recess 30, 32 extending into the mounting tabs 22, 24 that receive the first 26 and second 28 mounting posts respectively. The recesses are shaped to allow the mounting tabs 22, 24 to pivot about the posts 26, 28 such that the cover 12 can be moved between a closed position, wherein it rests on the cover receiving flange 42 and covers the access opening 15 and an open position providing access to the access opening 15. In one embodiment, shown in FIGS. 1, 3, 8 and 14, the cover 12 in the open position is oriented at approximately 90 degrees from the closed position. The cover 12 may additionally be capable of pivoting to a use position, shown in FIGS. 4, 9 and 13, which in the illustrated embodiment is oriented approximately 120 degrees from the closed position. The open position and use position may, of course, be set at different angles depending on the desired application.

Figure 8:
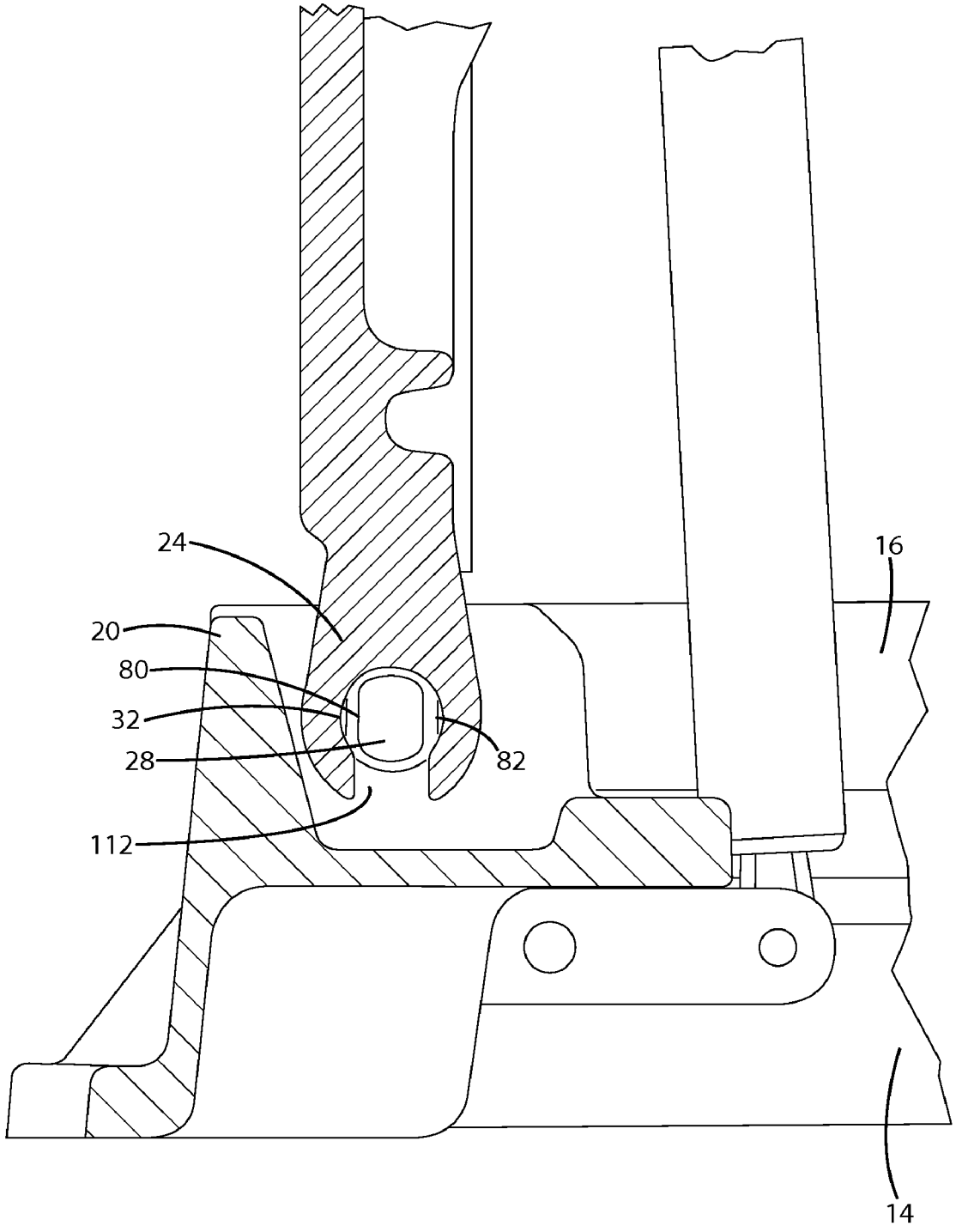
FIG. 8 is a close-up sectional view of the cover assembly in an open position taken along line 8 in FIG. 3.
Figure 9:
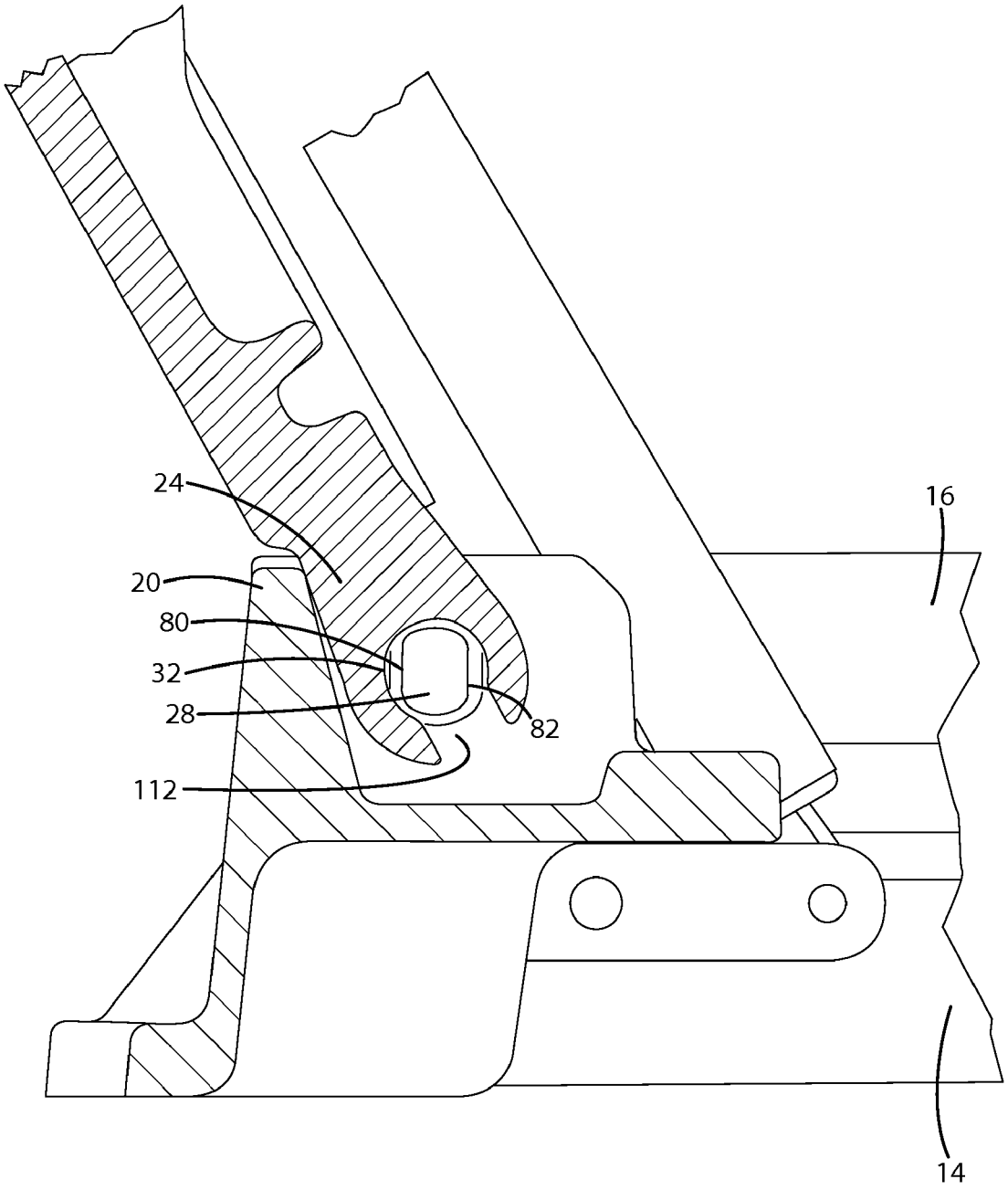
FIG. 9 is a close-up sectional view of the cover assembly in a use position taken along line 9-9 in FIG. 4.

Referring to FIGS. 11-14, in one embodiment, the recess 30 of the first mounting tab 22 includes a first portion 100 that is generally rounded, a locking groove 102 extending from the first portion 100, and a slot opening extending from the first portion 100. The first portion 100 includes a front wall 101 having a radius that is approximately the same as the radius of the curved portions of the first cover mount post 26 to enable the post 26 to smoothly pivot within the first portion 100. The rear wall 103 is generally flat. The locking groove 102, shown in FIGS. 11-14, includes opposing, generally parallel sides 106, 108 that extend in the same direction as the opposing flat sides 80, 82 on the first cover mount post 26. The sides 106, 108 are spaced apart at about the same distance as the flat sides 80, 82 of the post 26, such that when the cover 12 is moved to the open position, the flat sides 80, 82 of the post 26 align with the flat sides 106, 108 of the locking groove 102 and post 22 slides into the locking groove 102 (see FIG. 14). As illustrated, the side 108 of the locking groove has a generally rounded upper corner 111 that is shaped to match the shape of the rounded leading edge 87 on the mounting post 26. The post 26 fits snugly within the locking groove 102 to hold the cover 12 in the open position until the cover 12 is lifted to move the post 26 out of the locking groove 102. Referring to FIGS. 8-9, in the illustrated embodiment, the recess 32 of the second mounting tab 24 is generally circular to enable smooth rotation of the post 28 within the recess 32, however, in one embodiment the recess 32 may also include a locking groove. The locking groove 102 and cover mount post 26 may otherwise have a different shape that permits the them to align and lock the cover 12 in a desired position. In an alternative embodiment, the recesses 30, 32 extend completely through the mounting tabs 22, 24. Alternative arrangements of the recesses 30, 32 and mounting posts 26, 28 may be used depending on the desired application. For instance, the mounting posts 26, 28 may extend from the mounting tabs 22, 24 on the cover 12 and the recesses 30, 32 may be defined in the frame extensions 18, 20.

Figure 14:
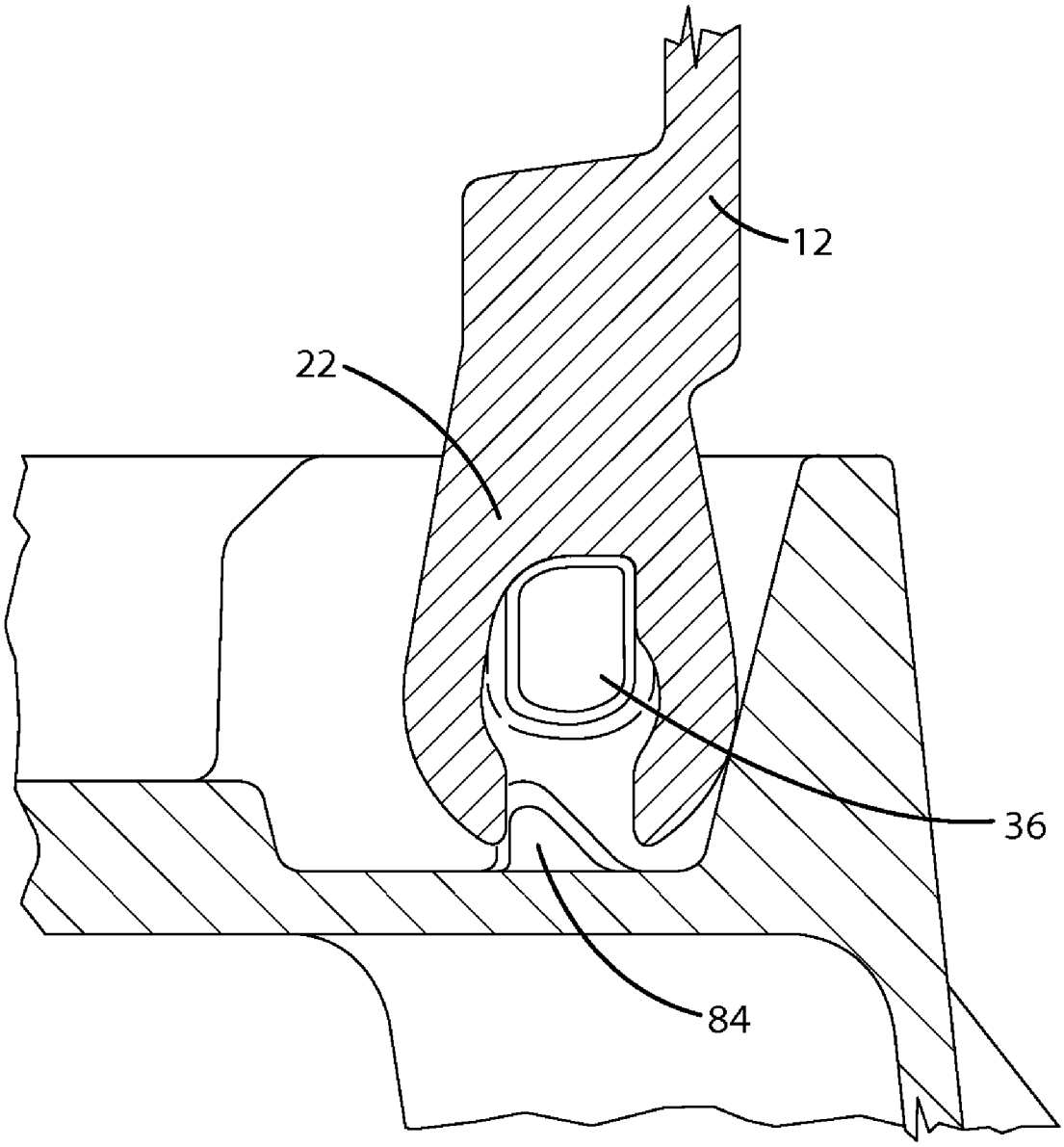
FIG. 14 is a close-up sectional view of the cover assembly in an open position taken along line 14-14 in FIG. 1.

In addition, the mounting tabs 22, 24 of the illustrated embodiment include slot openings 110, 112 that permit removal of the cover 12 from the frame 14 when the cover 12 is moved to a desired position. In the illustrated embodiment, the slot openings 110, 112 extend from the recesses 30, 32, and are positioned and sized such that mounting tabs 22, 24 can be pulled off the posts 26, 28 when the cover 12 is in the open position. As illustrated, the slot opening 110 in the first mounting tab 22 is positioned opposite the locking groove 102 and sized such that the parallel walls 80, 82 fit through the slot opening when the cover 12 is in the open position. As shown in FIG. 14, when the cover 12 is in the open position, the protrusion 84 extends into the slot opening 110 of the first mounting tab 22 to provide additional resistance against movement of the cover 12 to the closed position. As shown in FIG. 13, when the cover 12 is opened to the use position, the mounting tab 22 may rest on the hypotenuse of the protrusion 84.

The manhole cover assembly 10 may additionally include a lift-assist mechanism 120 for moving the cover 12 between the open and closed positions. A variety of lift-assist mechanisms may be used, and in the illustrated embodiment, the assembly 10 includes a gas assist cylinder 120 connected between the cover 12 and the frame 14.

III. Operation

Figure 2:
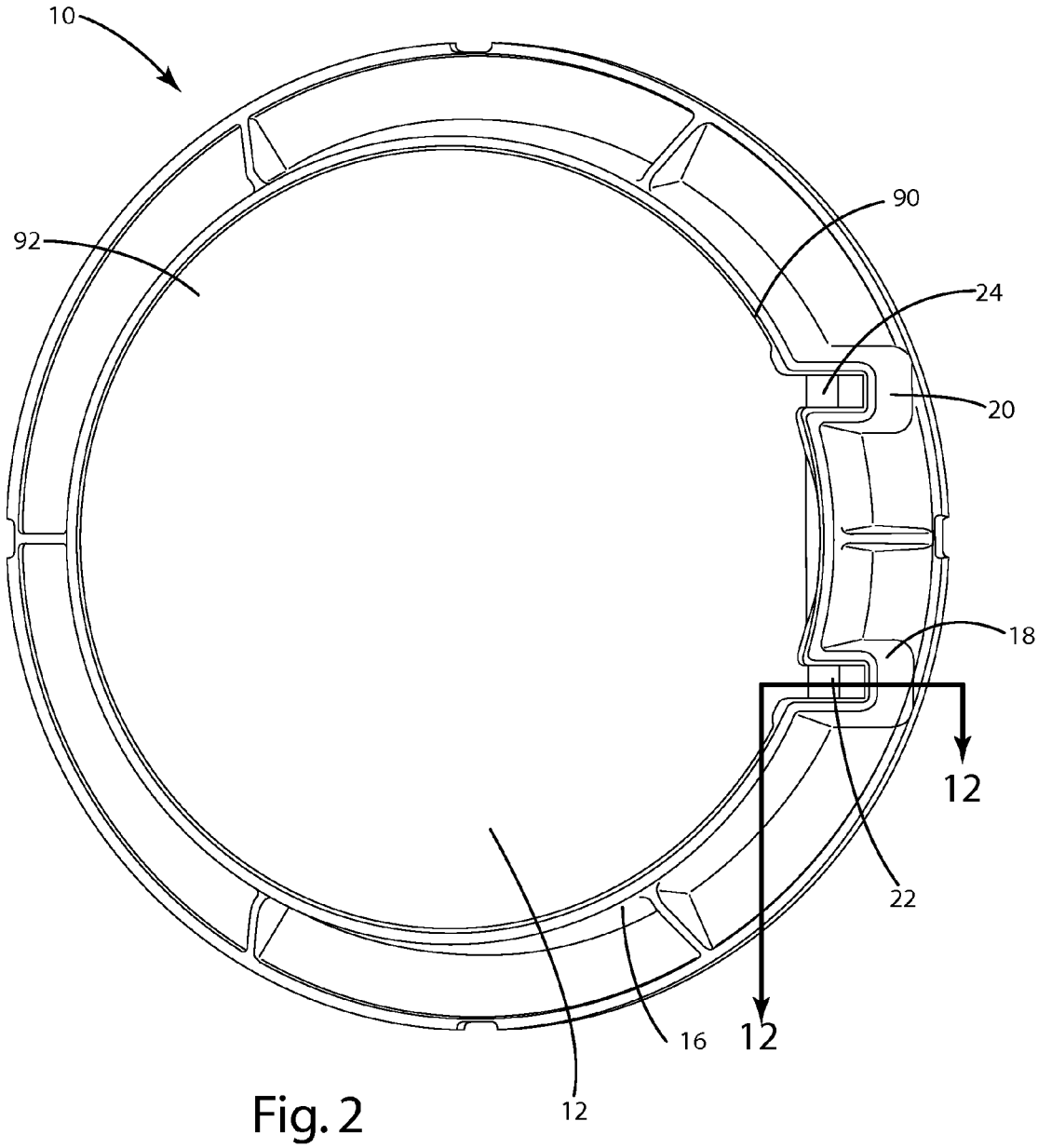
FIG. 2 is a top view of the manhole cover assembly in a closed position.
Figure 3:
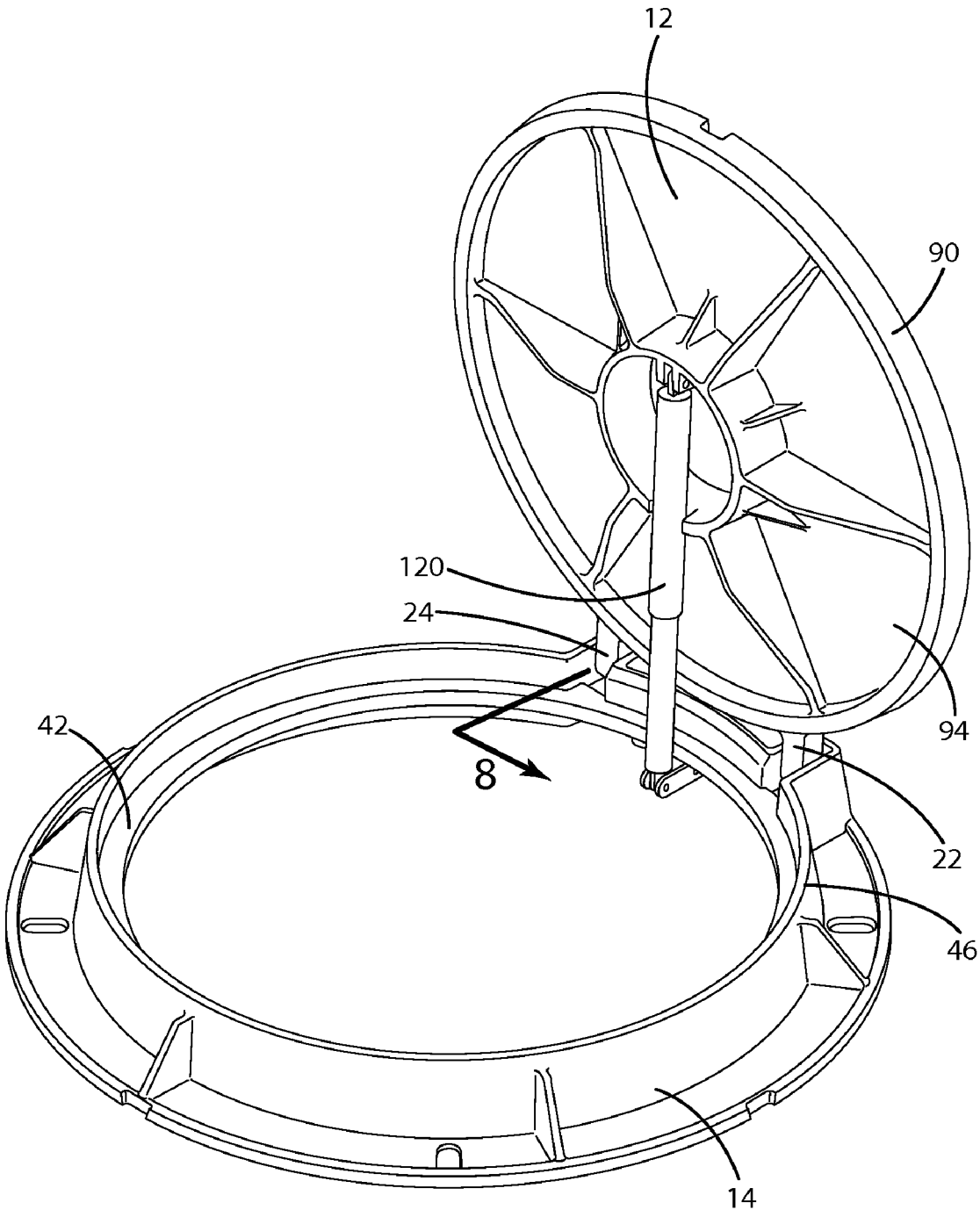
FIG. 3 is a front perspective view of the manhole cover assembly in an open position.
Figure 12:
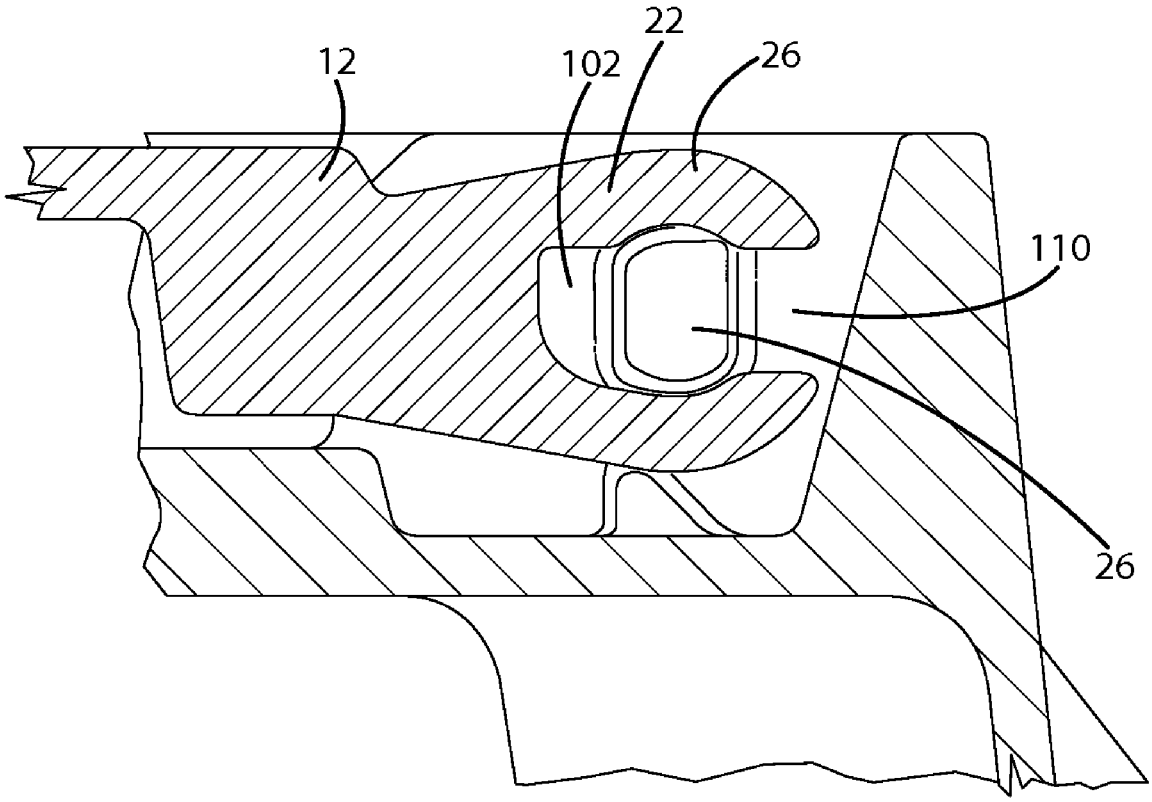
FIG. 12 is a close-up sectional view of the cover assembly in a closed position taken along line 12-12 in FIG. 2.
Figure 15:
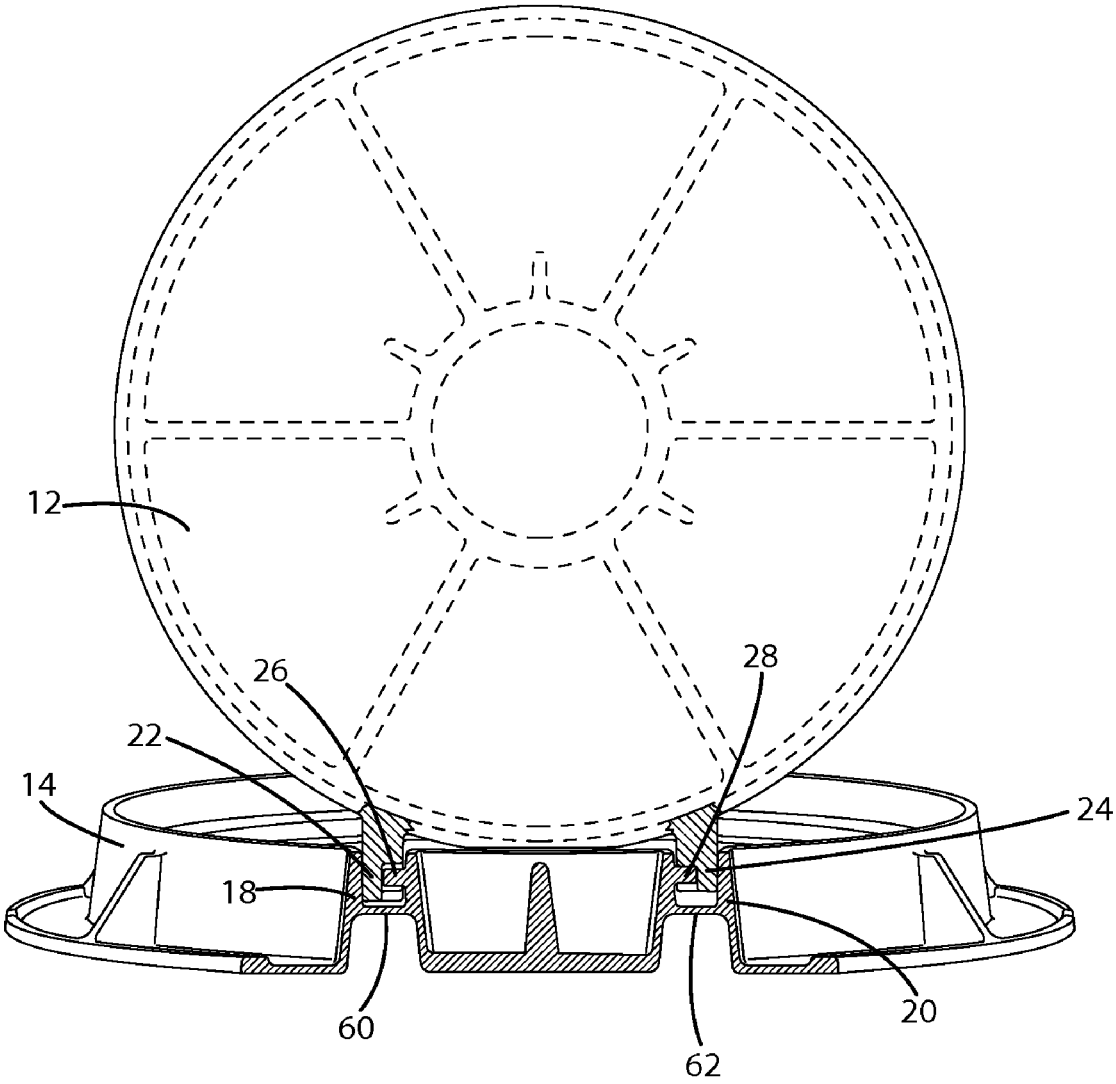
FIG. 15 is a sectional view of the cover assembly in an open position taken along line 15-15 in FIG. 1.

In operation, the cover 12 of the illustrated embodiment may be moved between the closed position, wherein the cover 12 covers the access opening, the open position and use position. As shown in FIG. 2, the cover 12 is positioned in the closed position with the bottom surface 94 resting on the cover receiving flange 42. As shown in FIG. 12, in this position, the first cover mount post 26 is positioned within the first portion 100 of the recess 30. The second cover mount post 28 is positioned within the second recess 32. The cover 12 may be lifted, either manually, or in the case of the illustrated embodiment, with the help of the lift-assist mechanism 120, such that the recesses 30, 32 rotate about the posts 26, 28. When the cover reaches the open position, which is about 90 degrees in the illustrated embodiment, the flat sides 80, 82 of the first cover mount post 26 align with the flat sides 106, 108 of the locking groove, and, as shown in FIG. 15, the cover 12 tilts to one side as the locking groove 102 slides down onto the post 26. In another embodiment wherein both recesses include locking grooves, the entire cover 12 may lower as the posts 26, 28 slide into the locking grooves. In addition, as the first cover mount post 26 slides into the locking groove 102, the protrusion 84 enters into the slot opening 110 on the first mounting tab 22. The cover 12 may also be removed from the frame 14 in the open position by lifting the cover to pull the posts 26, 28 through the slot openings 110, 112.

In order to move the cover 12 from the open position, the user lifts the cover 12 until the cover mount post 26 moves out of the locking groove 102 and back into the first portion 100 of the recess 30. The cover 12 may then me moved farther open, to the use position, or to the closed position.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A manhole cover assembly comprising:

a frame having a peripheral wall defining an access opening;

first and second frame extensions adjacent said peripheral wall, said first and second frame extensions each including a sidewall and a floor;

a first cover mount post extending from said sidewall of said first frame extension and a second cover mount post extending from said sidewall of said second frame extension, said first and second cover mount posts positioned above said floors of said first and second frame extensions such that said posts are sealed from said access opening;

a manhole cover including first and second mounting tabs, said first mounting tab defining a recess receiving said first cover mount post, said second mounting tab including a recess receiving said second cover mount post, said first and second mounting tabs rotating about said first and second cover mount posts between a closed position covering said access opening and an open position providing access to said access opening, wherein said first cover mount post extends into said first mounting tab recess in said closed position and said open position, and said second cover mount post extends into said second mounting tab recess in said closed position and said open position; and wherein said first mounting tab recess includes a first portion shaped to allow said first mounting tab to rotate about said first cover mount post, and a locking groove extending from said first portion of said first mounting tab recess, said first cover mount post sliding from said first portion into said locking groove when said cover is moved to said open position to lock said cover in said open position, wherein said first cover mount post includes an outer surface having opposing parallel surfaces extending in a first direction, said first direction being parallel to said cover in said open position, wherein said locking groove includes opposing sides extending generally in said first direction, wherein said second mounting tab recess is shaped differently than said first mounting tab recess, such that said locking groove is exclusive to said first mounting tab recess.

2. The manhole cover assembly of claim 1 wherein said first and second mounting tab recesses each include a slot opening positioned and sized to permit insertion and removal of said cover mount posts in said recesses when said cover is in said open position.

3. The manhole cover of claim 2 wherein said floor of said first frame extension includes an upper surface opposite said access opening, and a protrusion extending upwardly from said upper surface, said protrusion extending into said slot opening of said first mounting tab when said cover is in said open position to prevent rotation of said cover to said closed position.

4. A manhole cover assembly comprising:

a frame defining an access opening;

a cover for covering said access opening;

first and second mounting posts extending from said frame, said posts sealed from said access opening; and first and second recesses defined in said cover, said first and second recesses pivotally receiving said first and second mounting posts respectively such that said cover is movable between an open position and a closed position, said first and second mounting posts pivoting within said first and second recesses and extending into said first and second recesses in both said open and said closed positions, wherein said first recess includes a first portion and a second portion, said first mounting post including a rounded portion engaging said first portion of said first recess and enabling a smooth rotation of said first mounting post within said first portion of said first recess, at least one other portion of said first mounting post that is generally flat for aligning with said second portion of said first recess when said cover is in said open position, said first mounting post moving from said first portion into said second portion when said cover is moved to said open position, said second portion of said first recess and said first mounting post shaped to prevent further rotation of said cover in a closing direction when said first mounting post is in said second portion.

5. The manhole cover assembly of claim 4 wherein said frame includes an upwardly extending peripheral wall, and first and second frame extensions extending from said peripheral wall and having an inner surface and a floor, said first and second mounting posts extending from said inner surface above said floor, said floor preventing contaminants from entering said access opening through said frame extension.

6. The manhole cover assembly of claim 5 wherein said second portion of said recess is a locking groove extending from said first portion, said locking groove including at least one generally flat wall, said first mounting post including at least one generally flat wall, said generally flat wall of said locking groove and said generally flat wall of said mounting post aligning when said cover is in said open position.

7. The manhole cover of claim 6 wherein said first mounting post includes opposing parallel surfaces that align with said locking groove when said cover is in said open position.

8. A manhole cover assembly comprising:

a frame defining an access opening;

a cover for covering said access opening;

first and second mounting posts extending from one of said frame and said cover; and first and second recesses defined in the other of said frame and said cover, said first and second recesses pivotally receiving said first and second mounting posts respectively such that said cover is movable between an open position and a closed position, said first and second mounting posts pivoting within said first and second recesses and extending into said first and second recesses in both said open and said closed positions, wherein said first recess includes a first portion and a second portion, at least a portion of said first mounting post aligning with at least a portion of said second portion when said cover is in said open position, said first mounting post moving from said first portion into said second portion when said cover is moved to said open position, said second portion of said first recess and said first mounting post shaped to prevent further rotation of said cover when said first mounting post is in said second portion, wherein said frame includes an upwardly extending peripheral wall, and first and second frame extensions extending from said peripheral wall and having an inner surface and a floor, said first and second mounting posts extending from said inner surface above said floor, said floor preventing contaminants from entering said access opening through said frame extension, wherein said second portion of said recess is a locking groove extending from said first portion, said locking groove including at least one generally flat wall, said first mounting post including at least one generally flat wall, said generally flat wall of said locking groove and said generally flat wall of said mounting post aligning when said cover is in said open position, wherein said first mounting post includes opposing parallel surfaces that align with said locking groove when said cover is in said open position, wherein said first recess includes a slot opening opposite said locking groove and a protrusion extending upwardly from said floor, said protrusion extending into said slot opening when said cover is in said open position.

9. The manhole cover of claim 8 wherein said second recess of said second mounting tab includes a generally circular portion and a slot opening, said slot openings of said first and second mounting tabs cooperating to permit removal of said cover from said frame when said cover is in said open position.

10. The manhole cover of claim 9 wherein said first and second recesses are defined in said first and second mounting tabs, wherein said first and second recesses face each other, and wherein said recesses do not extend completely through said first and second mounting tabs.

11. A manhole cover assembly comprising:

a frame including a peripheral wall defining an access opening, said frame including first and second frame extensions extending from said peripheral wall, said first and second frame extensions each including a sidewall defining a frame extension opening, a mounting post extending from said sidewall, and a floor completely filling said frame extension opening to separate said mounting post from said access opening, said first mounting post including a rounded portion and a generally flat locking portion; and a cover including first and second mounting tabs pivotally mounted on said first frame extension post and said second frame extension post respectively, whereby said cover is pivotable about said first and second frame extension posts between both a closed position covering said access opening and an open position providing access to said access opening, said first mounting tab defining a recess that receives said first mounting post, said recess including a rotation portion that engages said rounded portion of said first mounting post to enable smooth rotation of said first mounting post within said recess, said recess including a locking groove extending from said rotation portion that aligns with and receives said locking portion of said first frame extension post when said cover is moved to said open position, whereby said first frame extension post moves from said rotation portion into said locking groove to hold said cover in said open position.

12. A manhole cover assembly comprising:

a frame including a peripheral wall defining an access opening, said frame including first and second frame extensions extending from said peripheral wall, said first and second frame extensions each including a sidewall defining a frame extension opening, a mounting post extending from said sidewall, and a floor completely filling said frame extension opening to separate said mounting post from said access opening; and a cover including first and second mounting tabs pivotally mounted on said first frame extension post and said second frame extension post respectively, whereby said cover is pivotable about said first and second frame extension posts between both a closed position covering said access opening and an open position providing access to said access opening, said first mounting tab defining a locking groove that aligns with and receives said first frame extension post when said cover is moved to said open position, whereby said first frame extension post moves into said locking groove to hold said cover in said open position, wherein said first and second mounting tabs each define a recess receiving said first and second frame extension posts respectively, said second mounting tab recess shaped to allow smooth rotation of said second mounting tab recess about said second frame extension post, said first mounting tab recess including a first portion shaped to allow smooth rotation of said first mounting tab recess about said first cover mount post, said locking groove extending from said first portion of said recess of said first mounting tab, wherein said recesses each include a slot opening permitting removal of said frame extension posts from said recesses when said cover is in said open position.

13. The manhole cover of claim 12 wherein said cover is movable to a use position different from said closed position and said open position, said cover providing access to said access opening in said use position.

14. The manhole cover of claim 12 wherein said slot opening of said first mounting tab is positioned opposite said locking groove.

15. The manhole cover of claim 14 wherein said frame includes a cover receiving flange extending from an inner surface of said peripheral wall, said cover receiving flange directly connected to and extending upwardly from said floors of said first and second frame extensions.

* * * * *